US010297984B2

(12) United States Patent
Sunshine

(10) Patent No.: US 10,297,984 B2
(45) **Date of Patent: *May 21, 2019**

(54) ION GENERATING DEVICE ENCLOSURE

(71) Applicant: PLASMA AIR INTERNATIONAL, INC, Stamford, CT (US)

(72) Inventor: Lawrence T. Sunshine, Rye Brook, NY (US)

(73) Assignee: PLASMA AIR INTERNATIONAL, INC, Stamford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/822,899

(22) Filed: Nov. 27, 2017

(65) Prior Publication Data

US 2018/0083424 A1 Mar. 22, 2018

Related U.S. Application Data

(63) Continuation of application No. 14/582,552, filed on Dec. 24, 2014, now Pat. No. 9,847,623.

(51) Int. Cl.
*H01T 23/00* (2006.01)
*H01T 19/04* (2006.01)

(52) U.S. Cl.
CPC ..... *H01T 23/00* (2013.01); *H01T 19/04* (2013.01)

(58) Field of Classification Search
CPC ..... H01T 23/00
USPC ..... 361/230
See application file for complete search history.

(56) References Cited

U.S. PATENT DOCUMENTS

| | | | |
|---|---|---|---|
| 3,551,743 | A | 12/1970 | Koepke et al. |
| 3,734,342 | A | 5/1973 | Patterson |
| 4,048,667 | A | 9/1977 | Brennecke |
| 4,107,755 | A | 8/1978 | Kiefer |
| 4,477,263 | A | 10/1984 | Shaver et al. |
| 4,809,127 | A | 2/1989 | Steinman et al. |
| 4,811,159 | A | 3/1989 | Foster, Jr. |
| 5,550,703 | A | 8/1996 | Beyer et al. |

(Continued)

FOREIGN PATENT DOCUMENTS

| | | |
|---|---|---|
| CA | 2 108 790 C | 2/2002 |
| JP | 2004-012087 A | 1/2004 |

(Continued)

OTHER PUBLICATIONS

Daniels S.L., ""On the Ionization of Air for Removal of Noxious Effluvia" (Air Ionization of Indoor Environments for Control of Volatile and Particulate Contaminants With Nonthermal Plasmas Generated by Dielectric-Barrier Discharge)", IEEE Transactions on Plasma Science 30(4):1471-1481 (Aug. 2002).

(Continued)

*Primary Examiner* — Dharti H Patel
(74) *Attorney, Agent, or Firm* — Scully, Scott, Murphy & Presser, P.C.

(57) ABSTRACT

The present disclosure is directed to ion generators and their enclosures that include a base, a non-linear wall projecting from the base, a top connected to the non-linear wall a top connected to the non-linear wall, wherein the base, the non-linear wall and the top form a closed space, and at least one ionizing element extending from the enclosure, wherein the at least one ionizing element is configured to receive a voltage capable of producing ions from a power source in the closed space.

21 Claims, 4 Drawing Sheets

(56) References Cited

U.S. PATENT DOCUMENTS

| | | | | |
|---|---|---|---|---|
| 5,570,266 | A | 10/1996 | Testone | |
| 5,893,977 | A * | 4/1999 | Pucci | C02F 1/4606 210/243 |
| 6,744,617 | B2 | 6/2004 | Fujii | |
| 6,807,044 | B1 | 10/2004 | Vemitsky et al. | |
| 6,850,403 | B1 | 2/2005 | Gefter et al. | |
| 6,987,658 | B2 | 1/2006 | Lu et al. | |
| 7,132,010 | B2 | 11/2006 | Carlsson | |
| 7,285,155 | B2 * | 10/2007 | Taylor | B03C 3/08 361/226 |
| 7,391,598 | B2 | 6/2008 | Fujiwara et al. | |
| 7,497,898 | B2 | 3/2009 | Sato et al. | |
| 7,695,552 | B2 | 4/2010 | Sato et al. | |
| 7,749,313 | B2 | 7/2010 | Byon et al. | |
| 7,948,733 | B2 | 5/2011 | Hashimoto | |
| 8,018,710 | B2 | 9/2011 | Fujita et al. | |
| 8,072,731 | B2 | 12/2011 | Shimada et al. | |
| 8,106,367 | B2 | 1/2012 | Riskin | |
| 8,134,821 | B2 | 3/2012 | Fukai et al. | |
| 8,564,924 | B1 | 10/2013 | Waddell et al. | |
| 8,710,456 | B2 | 4/2014 | Klochkov et al. | |
| 8,861,167 | B2 | 10/2014 | Waddell et al. | |
| 8,861,168 | B2 | 10/2014 | Waddell et al. | |
| 8,873,215 | B2 | 10/2014 | Waddell | |
| 9,025,303 | B2 | 5/2015 | Waddell et al. | |
| 9,168,538 | B2 | 10/2015 | Waddell | |
| 9,289,779 | B2 | 3/2016 | Waddell et al. | |
| 9,478,948 | B2 | 10/2016 | Waddell | |
| 9,509,125 | B2 | 11/2016 | Waddell et al. | |
| 9,847,623 | B2 * | 12/2017 | Sunshine | H01T 19/04 |
| 2005/0063130 | A1 * | 3/2005 | Francis | H01T 23/00 361/220 |
| 2006/0022495 | A1 | 2/2006 | Dehli | |
| 2007/0126363 | A1 | 6/2007 | Sato et al. | |
| 2008/0098895 | A1 | 5/2008 | Sato et al. | |
| 2008/0202335 | A1 | 8/2008 | McKinney et al. | |
| 2009/0103229 | A1 | 4/2009 | Jung et al. | |
| 2009/0321544 | A1 | 12/2009 | Akisada et al. | |
| 2010/0241306 | A1 | 9/2010 | Akisada et al. | |
| 2012/0056541 | A1 | 3/2012 | Mamiya et al. | |
| 2012/0154973 | A1 | 6/2012 | Vaynerman et al. | |
| 2012/0287551 | A1 | 11/2012 | Waddell et al. | |
| 2013/0232807 | A1 | 9/2013 | Robert et al. | |
| 2013/0336838 | A1 | 12/2013 | Waddell | |
| 2014/0029155 | A1 | 1/2014 | Waddell | |
| 2014/0076162 | A1 | 3/2014 | Waddell et al. | |
| 2014/0078639 | A1 | 3/2014 | Waddell et al. | |
| 2014/0209799 | A1 | 7/2014 | Waddell | |
| 2014/0338535 | A1 | 11/2014 | Pucciani et al. | |
| 2014/0373817 | A1 | 12/2014 | Waddell et al. | |
| 2014/0375208 | A1 | 12/2014 | Waddell | |

FOREIGN PATENT DOCUMENTS

| | | | |
|---|---|---|---|
| JP | 2005-142131 | A | 6/2005 |
| JP | 2005-337610 | A | 12/2005 |
| JP | 2008-089301 | A | 4/2008 |
| WO | 2008/004454 | A1 | 1/2008 |
| WO | 2008/054125 | A1 | 5/2008 |

OTHER PUBLICATIONS

Integrate Sterionizer™ Window into your A/C System. Datasheet [online]. FILT AIR Ltd, Jan. 2009 [Retrieved on Jan. 5, 2017] Retrieved from the Internet: < http://www.sterionizer.com/wp-content/uploads/downloads/window/2012_06_26_09_04_52/document.pdf> (4 pages) (Jun. 17, 2012).

"Wide Area Ionizer" is the choice for your production site. Datasheet [online]. SUNX Limited, Mar. 2009 [retrieved on Sep. 18, 2015]. Retrieved from the Internet: <https://www.panasonic-electric-works.com/cps/rde/xbcr/pewnew/ds_63165_1000_en_ertf.pdf> (8 pages) (Mar. 2009).

Installation, Operation & Maintenance Manual. Datasheet [online]. Plasma Air International, [Retrieved on Jan. 7, 2016] Retrieved from the Internet: < http://www.plasma-air.com/sites/default/files/Plasma_Air_Plasma_BAR_IOM_Manual_0.pdf> (4 pages) (Jul. 2014).

Ionization Product Submittal. Datasheet [online]. Plasma Air International, [Retrieved on Jan. 7, 2016] Retrieved from the Internet: < http://www.plasma-air.com/sites/default/files/Plasma_Air_BAR_Submittal_0.pdf> (1 page) (2014).

Ionizer. Datasheet [online]. SMC Corporation, [retrieved on Jan. 5, 2017] Retrieved from the Internet: <http://content2.smcetech.com/pdf/IZS31.pdf> (35 pages) (2007).

Air Purification System Models IG-40 & IG-40R. Datasheet, Bioclimatic Air Systems, LLC., Jul. 2009 [retrieved on Jan. 5, 2017] (12 pages) (Jul. 2009).

Sterionizer. Datasheet, FILT AIR Ltd, Oct. 2005 [retrieved on Sep. 30, 2015] (2 pages) (Oct. 2005).

Static Ionizer is for use in cell manufacturing facilities. Press Release [online]. Thomasnet Aug. 28, 2008 [Retrieved on Jan. 5, 2017] Retrieved from the Internet: < http://news.thomasnet.com/fullstory/static-ionizer-is-for-use-in-cell-manufacturing-facilities-819753> (5 pages) (Aug. 2008).

Nishikawa, K. et al., "Indoor Suspended Allergen Inactivation Technology Using Cluster Ions Generated by Discharge Plasma", Sharp Technical Journal, Aug. 2004, No. 89, pp. 55-60.

Ionization Product Submittal, Model PA600, 2014, pp. 1.

Notice of Allowance dated Aug. 11, 2017 received in related U.S. Appl. No. 14/582,552.

U.S. Office Action dated Apr. 21, 2017 received in related U.S. Appl. No. 14/582,552.

U.S. Office Action dated Dec. 1, 2016 received in related U.S. Appl. No. 14/582,552.

U.S. Office Action dated May 26, 2016 received in related U.S. Appl. No. 14/582,552.

* cited by examiner

ION GENERATING DEVICE ENCLOSURE

CROSS-REFERENCE TO RELATED APPLICATIONS

The present application is a continuation of U.S. Ser. No. 14/582,552, filed Dec. 24, 2014, the entire contents of which are incorporated by reference.

FIELD OF THE DISCLOSURE

The present disclosure is directed to ion generator devices and enclosures. The present disclosure is further directed to ion generator devices that are configured to be placed on, in, or a combination of on and in heating, ventilating and air-conditioning (HVAC) elements, including but not limited to Roof Top Units (RTUs), air handling units (AHU), fan coil units (FCU), Variable Refrigerant Volume Units (VRVU), Variable Refrigerant Flow Units (VRFU) and Packaged Terminal Air Conditioner (PTAC) units, and also including heat pumps, ducts, air inlets, and air outlets.

BACKGROUND OF THE DISCLOSURE

An air ionizer typically includes electrodes to which high voltages are applied. Gas molecules near the electrodes become ionized when they either gain or lose electrons. Because the ions take on the charge of the nearest electrode, and like charges repel, they are repelled from that electrode. In typical air ionizers, an air current is introduced to the device in order to carry the ions away from the electrodes to a "target region" where an increased ion content is desired.

Ions in the air are attracted to objects carrying an opposite charge. When an ion comes in contact with an oppositely charged object, it exchanges one or more electrons with the object, lessening or eliminating the charge on the object. Thus, ions in the air can reduce contamination of objects in the environment.

SUMMARY OF THE DISCLOSURE

The present disclosure is directed to ion generators and their enclosures that include a base, a non-linear wall projecting from the base, a top connected to the non-linear wall, wherein the base, the non-linear wall and the top form an enclosed space, and at least one ionizing element extending from the device, wherein the at least one ionizing element is configured to receive a voltage capable of producing ions from a power source in the closed space.

BRIEF DESCRIPTION OF THE DRAWINGS

The present disclosure will be better understood by reference to the following drawings of which.

DETAILED DESCRIPTION OF THE DISCLOSURE

The disclosure includes ion generator devices and ion generator device enclosures that can be used for any suitable purpose, including placement on, in, or a combination of on and in heating, ventilating and air-conditioning (HVAC) elements, including but not limited to Roof Top Units (RTUs), air handling units (AHU), fan coil units (FCU), Variable Refrigerant Volume Units (VRVU), Variable Refrigerant Flow Units (VRFU) and Packaged Terminal Air Conditioner (PTAC) units, and also including heat pumps, ducts, air inlets, and air outlets.

Other suitable purposes for use of the disclosed ion generator device and ion generator device enclosures is placement on, in, or a combination of on and in hand dryers, hair dryers, vacuum cleaners, variable air volume diffusers, refrigerators, freezers, automobile ventilation elements (including cars, trucks, recreational vehicles, campers, boats and planes) and light fixtures. Along with producing ions, the disclosed ion generator devices can also reduce static electricity when placed on, in or a combination of on and in any of the elements or items listed above.

In the discussion and claims herein, the term "about" indicates that the value listed may be somewhat altered, as long as the alteration does not result in nonconformance of the process or structure to the illustrated embodiment. For example, for some elements the term "about" can refer to a variation of ±0.1%, for other elements, the term "about" can refer to a variation of ±1% or ±10%, or any point therein.

Figure 1:
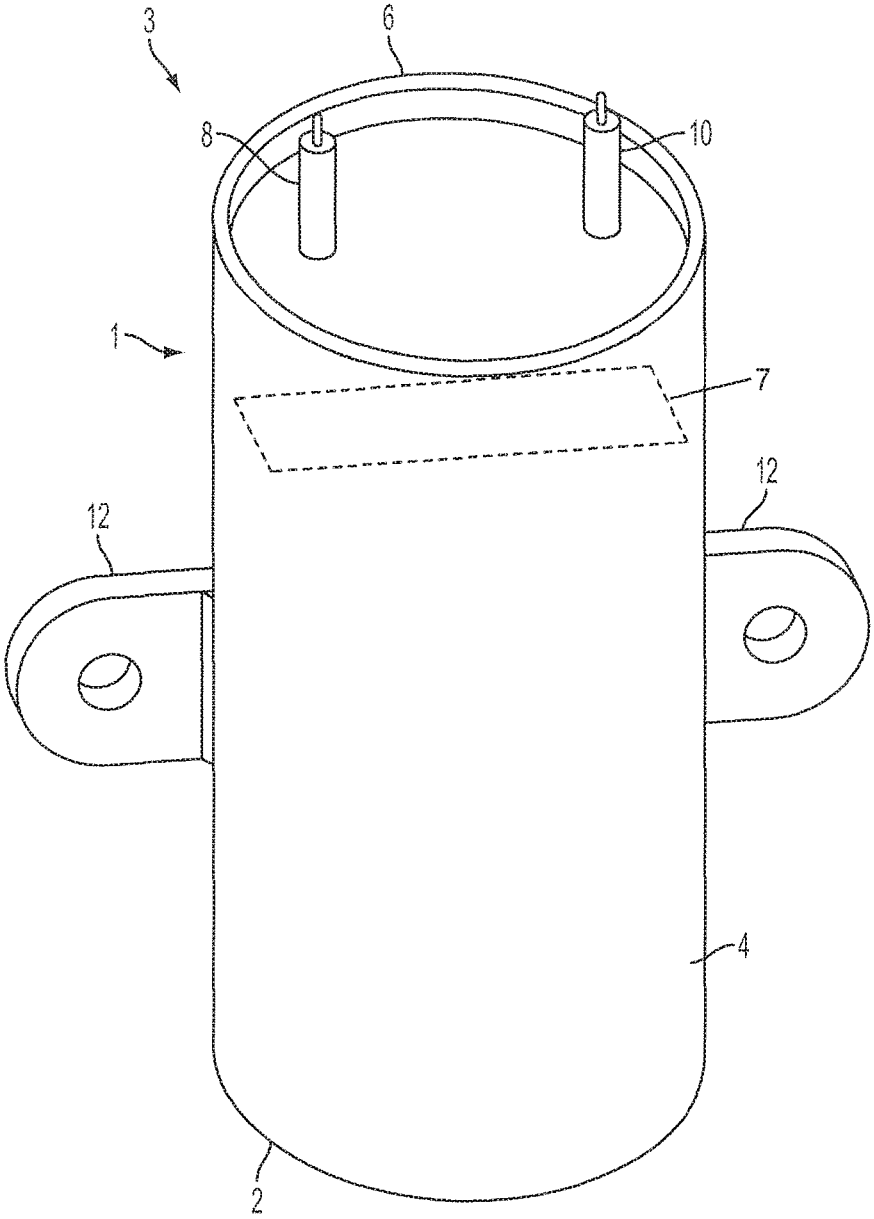
FIG. 1 is a perspective view of an embodiment of an ion generator device enclosure.

FIG. 1 of the present disclosure illustrates a perspective view of an ion generator device 3 having an enclosure 1. The enclosure 1 includes a base 2, a non-linear wall 4 that projects from base 2 and a top 6 that is connected to the non-linear wall 4. In FIG. 1, a closed internal space is formed by base 2, non-linear wall 4 and top 6. This closed internal space is configured to contain a power source 7, which is further discussed below.

Base 2, non-linear wall 4 and top 6 of ion generator device enclosure 1, as well as other components of other embodiments of ion generator devices such as linear walls and flanges discussed below, can be formed of one or more of the same or different materials, which can be any material suitable to maintain a rigid or semi-rigid structure and allow for the production of positive and negative ions with little or no interference. Some non-limiting examples of the one or more materials forming the base 2, non-linear wall 4 and top 6 of ion generator device enclosure 1 are suitable plastics, such as polycarbonates, vinyls, polyethylenes, polyvinyl chloride, polypropylene, acrylonitrile butadiene styrene (ABS) and polystyrene, suitable metals including galvanized steel, stainless steel and aluminum, and natural and synthetic rubbers.

As shown in FIG. 1, an ionizing element 8 is shown extending from the top 6 of ion generator device enclosure 1. Ionizing element 8 could be placed in any suitable location on ion generator device enclosure 1. The ion generator device enclosure 1 optionally may include 2 or more ionizing elements. As shown in FIG. 1, a second ionizing element 10 is placed on top 6 of ion generator device enclosure 1. Ionizing elements 8 and 10 are configured to receive a current from the power source 7 within the ion generator device enclosure 1 and are capable of producing ions from the received current. Power source 7 can include any circuit board with suitable electrical circuitry (not shown), including a suitable transformer, that is configured to receive an input voltage and current and output a suitable voltage and current to ionizing elements 8 and 10, so that ionizing elements 8 and 10 can produce ions. The power source 7 provides power to the ionizing elements 8 and 10 to produce positive ions, negative ions or a combination of positive ions and negative ions.

In this embodiment suitable wires can enter ion generator device enclosure 1 to deliver current and voltage to power source 7.

The ionizing elements can be any element capable of producing positive ions, negative ions or a combination of positive ions and negative ions, such as an ionizing needle, an ionizing brush and an ionizing tube, at various intensities as desired. For illustrative purposes, as shown in FIG. 1, ionizing elements 8 and 10 are ionizing needle elements, which are rod shaped and come to a point at one end. In other embodiments, the ionizing elements can be an ionizing brush, which can contain a plurality of bristles or fibers formed of a conductive material. In other embodiments, each of ionizing element 8 and second ionizing element 10 can be an ionizing tube, which includes a tube that is surrounded by at least one electrode that is capable of producing positive ions, negative ions or a combination of positive ions and negative ions. Each of the ionizing needle, ionizing brush and ionizing tube can include components formed of a material sufficient to emit ions, such as, for example, a conductive metal, a conductive polymer, a conductive semi-fluid and a carbon material.

Ionizing elements 8 and 10 can be used to adjustably create various ion concentrations in a given volume of air, as desired. These ionizing elements can also be used to produce about equal amounts of positive and negative ions, regardless of airflow and other environmental conditions, as desired. In some embodiments, ionizing elements 8 and 10 can be used to create about $10^9$ ions/second or more, or less as desired.

Figure 2:
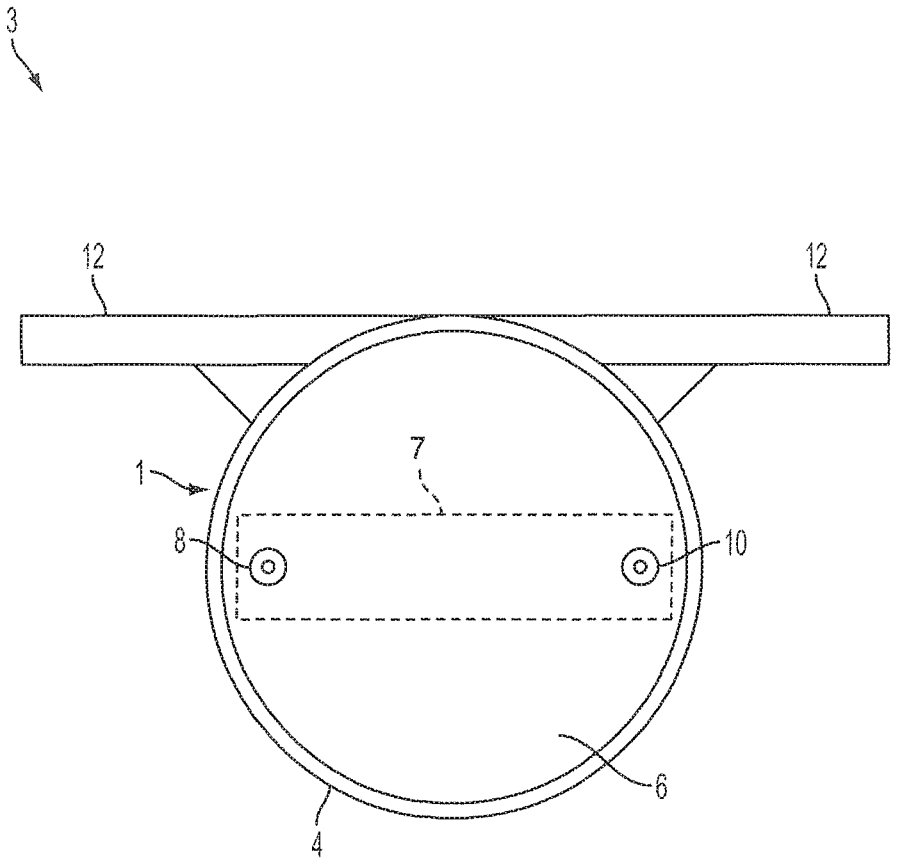
FIG. 2 is a top view of an embodiment of an ion generator device enclosure.

As shown in FIG. 1, ion generator device enclosure 1 can also include one or more flanges 12, which are connected to non-linear wall 4. The one or more flanges 12 can be used to secure ion generator device enclosure 1 to a surface by any suitable connection means, such as a screw, nail, clip, adhesive, rivet, grommet, bolt, magnetic connectors, hook and loop fasteners, straps and the like. Referring to FIG. 2, which is a top view of ion generator device enclosure 1, it can be seen that one or more flanges 12 are connected to non-linear wall 4.

FIG. 2 is a top view of ion generator device enclosure 1, showing non-linear wall 4 as having a substantially circular cross section. In other embodiments non-linear wall 4 can include any other non-linear shape, including having an oval cross-section, an irregular cross section or being a portion of a circular shape. Although non-linear wall 4 is shown in FIGS. 1 and 2 as being straight between base 2 and top 6, non-linear wall 4 can be any shape between base 2 and top 6, including a curved shape, and angular shape or an irregular shape.

Although not shown in FIG. 2, top 6 can include various indicators or screens to notify a user to the operability of the power source 7 contained in enclosure 1. For instance, top 6 can include various lights, including one or more light emitting diodes (LEDs), and top 6 can include various displays, including one or more thin film transistor (TFT) displays, to indicate the operability of the ion generator device enclosure 1, such as operating efficiency or whether one or more components of ion generator device enclosure 1 have failed. These various indicators can be electrically connected to circuitry and wiring externally through top 6 of ion generator device enclosure 1.

Ion generator device enclosure 1 can be used for any suitable purpose, including placement on, in, or a combination of on and in HVAC elements, including but not limited to RTUs, AHUs, FCUs, VRVUs, VRFUs, PTAC units, heat pumps, ducts, air inlets, air outlets, as well as on, in, or a combination of on and in hand dryers, hair dryers and vacuum cleaners. Ion generator device enclosure 1 also can be connected to an arm or a bar that extends across or partially across the interior of an HVAC element.

Ion generator device enclosure 1 can be placed in any suitable relationship to an inlet air flow. These suitable relationships include orientations so the ionizing elements 8 and 10 are perpendicular, parallel to, or at an angle offset, from the inlet air flow.

Ion generator device enclosure 1 can also be used in conjunction with or in combination with a filter, such as a mesh, screen, paper or cloth filter. Ion generator device enclosure 1 can also be used in conjunction with or in combination with various cooling or heating elements, such as heating coils or cooling coils.

Figure 3:
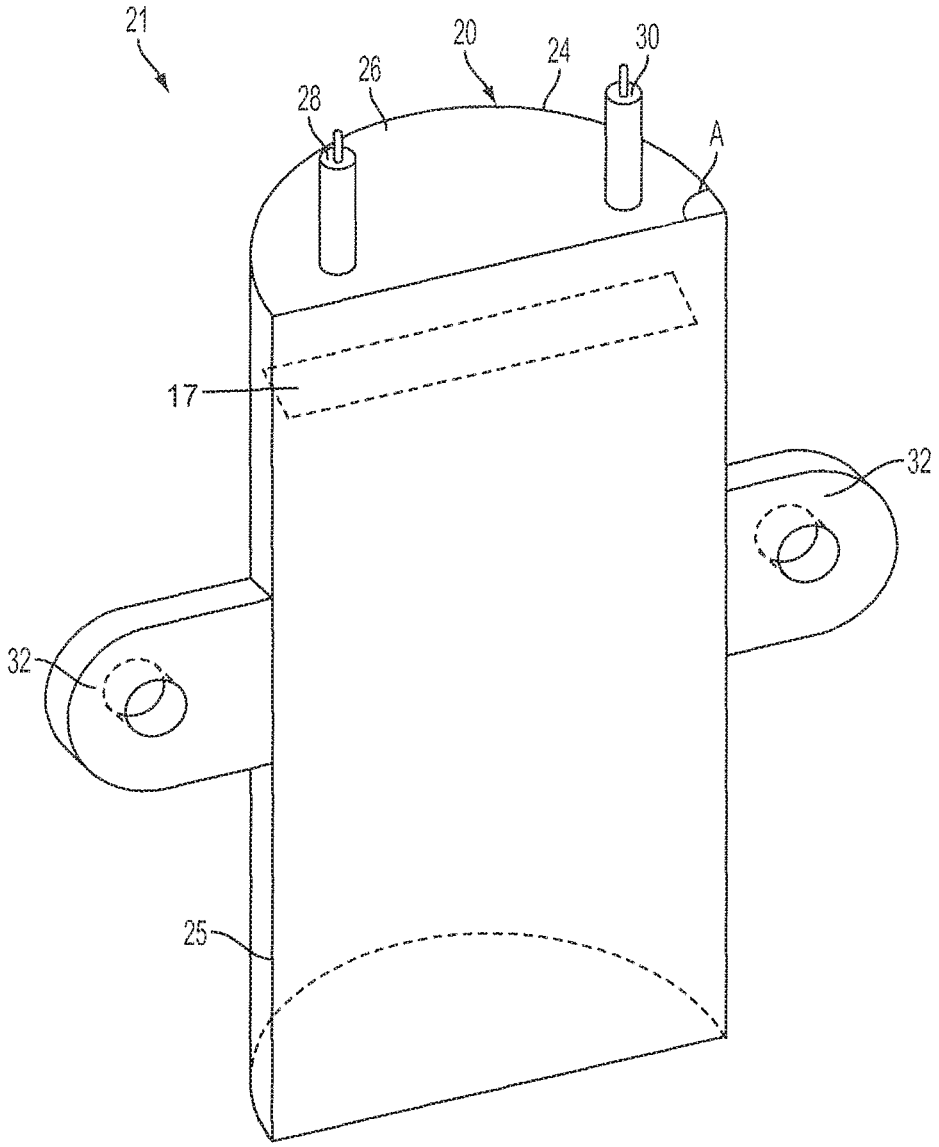
FIG. 3 is a perspective view of an embodiment of an ion generator device enclosure.

FIG. 3 of the present disclosure illustrates a perspective view of an ion generator device 21 having an enclosure 20. As shown in FIG. 3, an ionizing element 28 is shown extending from the top 26 of ion generator device enclosure 20. Ionizing element 28 could be placed in any suitable location on ion generator device enclosure 20. The ion generator device enclosure 20 optionally may include 2 or more ionizing elements. Also shown in FIG. 3 is a second ionizing element 30 placed on top 26 of ion generator device enclosure 20. Ionizing elements 28 and 30 are configured to receive a current from a power source 17 within the ion generator device enclosure 20 and are capable of producing ions from the received current.

The power source 17 provides power to the ionizing elements 28 and 30 to produce positive ions, negative ions or a combination of positive ions and negative ions. Power source 17 can include any circuit board with suitable electrical circuitry (not shown), including a suitable transformer, that is configured to receive an input voltage and current and output a suitable voltage and current to ionizing elements 28 and 30, so that ionizing elements 28 and 30 can produce ions. The power source 17 provides power to the ionizing elements 28 and 30 to produce positive ions, negative ions or a combination of positive ions and negative ions.

In this embodiment suitable wires can enter ion generator device enclosure 20 to deliver current and voltage to power source 17.

As shown in FIG. 3, the ion generator device enclosure 20 can include a non-linear wall 24 and a linear wall 25. Non-linear wall 24 is shown as having a substantially semi-circular or half-circular cross section. In other embodiments non-linear wall 24 can include any other non-linear shape, including having an oval cross-section, an irregular cross section or a portion of a circular shape.

Ion generator device enclosure 20 includes linear wall 25, non-linear wall 24, top 26 and a base (not shown) opposite of top 26. Linear wall 25, non-linear wall 24, top 26 and the base form a closed space within ion generator device enclosure 20. This internal space is configured to contain power source 17.

The ionizing elements can be any element capable of producing ions from a current received from the power source 17, including positive ions, negative ions or a combination of positive ions and negative ions, such as an ionizing needle, an ionizing brush and an ionizing tube, at various intensities as desired. For illustrative purposes, as shown in FIG. 3, ionizing elements 28 and 30 are ionizing needle elements. In other embodiments, each of ionizing elements 28 and 30 can be an ionizing brush, and an ionizing tube, as discussed above.

Although non-linear wall 24 is shown in FIG. 3 as being straight between a base and top 26, non-linear wall 24 can be any shape between the base and top 26, including a curved shape, and angular shape or an irregular shape.

As shown in FIG. 3, ion generator device enclosure 20 can also include one or more flanges 32, which are connected to non-linear wall 24. In other embodiments, one or more of flanges 32 can also be connected to linear wall 25 or both non-linear wall 24 and linear wall 25. The one or more flanges 32 can be used to secure ion generator device enclosure 20 to a surface by any suitable connection means, such as a screw, nail, clip, adhesive, rivet, grommet, bolt, magnetic connectors, hook and loop fasteners, straps and the like.

In the embodiment shown in FIG. 3, linear wall 25 spans the diameter of the half-circle formed by non-linear wall 24, such that an interior angle A between linear wall 25 and non-linear wall 24 is formed at about 90°. In the embodiment shown in FIG. 4, linear wall 25 is a chord that spans a distance between either end of non-linear wall 24. Thus, non-linear wall 24 forms a segment of a circle in FIG. 4 that is less than a half circle.

Figure 4:
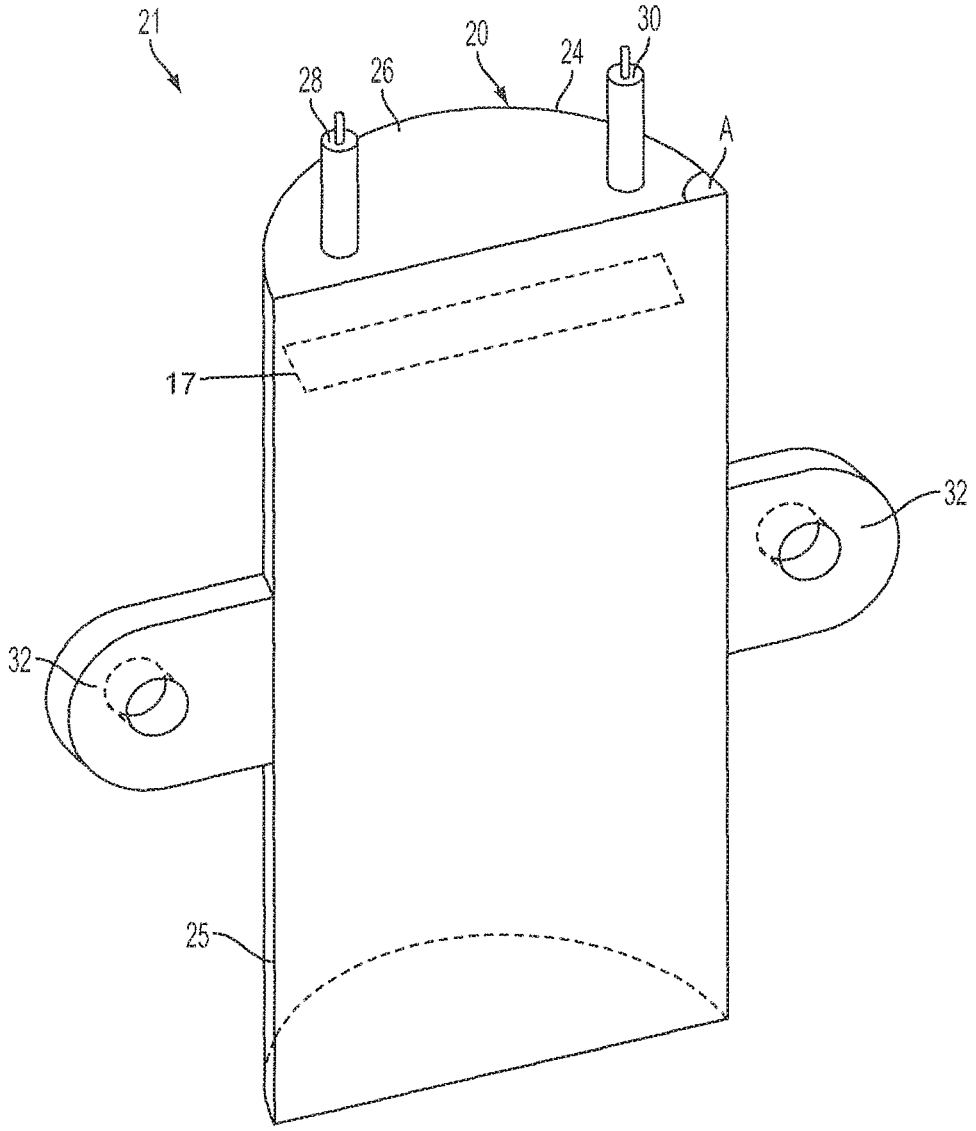
FIG. 4 is a perspective view of an embodiment of an ion generator device enclosure.

In FIG. 4, interior angle A is less than 90°, and in the embodiment shown in FIG. 4, is about 88°. In other embodiments, linear wall 25 can form a chord that creates a smaller segment of non-linear wall 24, such that interior angle A is between less than 90° and about 5°, specifically, interior angle A can be about 10°, about 15°, about 20°, about 25°, about 30°, about 35°, about 40°, about 45°, about 50°, about 55°, about 60°, about 65°, about 70°, about 75°, about 80°, about 85° or about 88°.

One benefit of the ion generator device enclosure 20 shown in FIGS. 3 and 4 is that ionizing elements 28 and 30 can be placed relatively far apart from each other without ion generator device enclosure 20 having a comparatively large volume. It is desirable to place ionizing elements 28 and 30 relatively far apart so that recombination of positively charged ions and negatively charged ions can be reduced. Ion generator device enclosure 20 will have a comparatively smaller volume than a cube, or rectangular box, which places two ionizing elements the same distance apart.

For example, if linear wall 25 of ion generator device enclosure 20 were 1 inch long and ion generator device enclosure 20 was 1 inch high, and ionizing elements 28 and 30 were placed as far apart as they could (about 0.9 inches) and interior angle A is 90°, the volume of ion generator device enclosure 20 would be about 0.39 in.$^3$($\pi$*(0.5 in.$^2$)/2*1 in). But, if an ion generator device were a square box, having a diagonal distance of 1 inch between 2 corners of the same face (so that each edge of the cube were 0.707 inches) and being 1 inch high, the volume of that cube would be 0.5 in.$^3$(0.707 in.*0.707 in.*1 in.), which is about 28% larger that the volume as that of ion generator device enclosure 20. This smaller volume with the same distance between two ionizing elements allows for ion generator device enclosure 20 to be placed in smaller areas and occupy less space in the component it is placed in, on, or a combination of in and on.

Further, since ion generator device enclosure 20 includes non-linear wall 24, which is a structurally strong shape, non-linear wall 24, linear wall 25, base (not shown) and top 26 can be formed of a thinner material as compared to the materials needed for a less structurally strong shape, such as a cube or a rectangular box.

The described embodiments and examples of the present disclosure are intended to be illustrative rather than restrictive, and are not intended to represent every embodiment or example of the present disclosure. While the fundamental novel features of the disclosure as applied to various specific embodiments thereof have been shown, described and pointed out, it will also be understood that various omissions, substitutions and changes in the form and details of the devices illustrated and in their operation, may be made by those skilled in the art without departing from the spirit of the disclosure. For example, it is expressly intended that all combinations of those elements and/or method steps which perform substantially the same function in substantially the same way to achieve the same results are within the scope of the disclosure. Moreover, it should be recognized that structures and/or elements and/or method steps shown and/or described in connection with any disclosed form or embodiment of the disclosure may be incorporated in any other disclosed or described or suggested form or embodiment as a general matter of design choice. Further, various modifications and variations can be made without departing from the spirit or scope of the disclosure as set forth in the following claims both literally and in equivalents recognized in law.

What is claimed is:

1. An ion generator device enclosure, comprising:

a base;

a non-linear wall projecting from the base;

one or more flanges connected to an external surface of the non-linear wall;

a top connected to the non-linear wall, wherein the base, the non-linear wall and the top form a space; and at least one ionizing element extending from the enclosure, wherein the at least one ionizing element is configured to receive a current capable of producing ions from a power source in the space.

2. The enclosure of claim 1, wherein the non-linear wall comprises a cylindrical wall with a cross section selected from the group consisting of a circular cross section and an oval cross section.

3. The enclosure of claim 1, wherein each of the at least one ionizing elements is selected from the group consisting of an ionizing needle, an ionizing brush and an ionizing tube.

4. The enclosure of claim 1, wherein the at least one ionizing element comprises a first ionizing element and a second ionizing element, the first ionizing element configured to produce positive ions and the second ionizing element configured to produce negative ions.

5. The enclosure of claim 4, wherein the first ionizing element and the second ionizing element produce substantially a same amount of positive and negative ions, respectively.

6. The enclosure of claim 1, wherein a light indicator is disposed on an external surface of the enclosure.

7. The enclosure of claim 6, wherein the light indicator is on the top.

8. The enclosure of claim 1, wherein the enclosure is dimensioned for positioning in an air conduit.

9. The enclosure of claim 8, wherein the air conduit is selected from a group consisting of an air handler unit (AHU), air duct, roof top unit (RTU), fan coil unit (FCU), Variable refrigerant volume units (VRVU), packaged terminal air conditioner units (PTAC) and variable refrigerant flow units (VRFU).

10. The enclosure of claim 9, further comprising a magnet configured to secure the enclosure to a surface of the air conduit.

11. The enclosure of claim 1, further comprising a transformer disposed within the enclosure, the transformer being coupled to an external power supply via wires.

12. The enclosure of claim 1, further comprising a display.

13. The enclosure of claim 12, wherein the display is configured to display operability of one or more components disposed within the enclosure.

14. The enclosure of claim 13, wherein the operability comprises a state of one or more components disposed within the enclosure, the state comprising a failure.

15. An ion generator device enclosure, comprising:

a base;

a non-linear wall projecting from the base;

a linear wall projecting from the base;

a top connected to the linear wall and non-linear wall, wherein the base, the linear wall, the non-linear wall and the top form a space; and at least one ionizing element extending from the enclosure, wherein the at least one ionizing element is configured to receive a current capable of producing ions from a power source in the space.

16. The enclosure of claim 15, further comprising:

one or more flanges connected to at least one of the linear wall and the non-linear wall, where a surface of the one or more flanges is co-planar with an exterior surface of the linear wall.

17. The enclosure of claim 15, wherein each of the at least one ionizing elements is selected from the group consisting of an ionizing needle, an ionizing brush and an ionizing tube.

18. The enclosure of claim 15, wherein the non-linear wall has a semi-circular or half-circular cross section.

19. The enclosure of claim 15, wherein the enclosure is dimensioned for positioning in an air conduit.

20. The enclosure of claim 15, wherein the at least one ionizing element comprises a first ionizing element and a second ionizing element, the first ionizing element configured to produce positive ions and the second ionizing element configured to produce negative ions.

21. The enclosure of claim 15, wherein the at least one ionizing element comprises a first ionizing element and a second ionizing element, each of the first ionizing element and the second ionizing element being configured to produce positive ions and negative ions.

* * * * *